United States Patent [19]

Krumes

[11] 3,937,124

[45] Feb. 10, 1976

[54] SETTABLE WARHEAD BURST RANGE SELECTOR

[75] Inventor: Rolf Krumes, Anaheim, Calif.

[73] Assignee: The United States of America as represented by the Secretary of the Army, Washington, D.C.

[22] Filed: Sept. 20, 1974

[21] Appl. No.: 507,834

[52] U.S. Cl. ..... 89/6.5
[51] Int. Cl.[2] ..... F42C 17/00
[58] Field of Search ..... 89/6.5, 1 R

[56] References Cited

UNITED STATES PATENTS

| | | | |
|---|---|---|---|
| 1,555,061 | 9/1925 | Karnes | 89/6.5 |
| 1,631,211 | 6/1927 | Karnes | 89/6.5 |
| 1,654,734 | 1/1928 | Karnes | 89/6.5 |

*Primary Examiner*—Charles T. Jordan
*Attorney, Agent, or Firm*—Nathan Edelberg; Robert P. Gibson; Max Yarmovsky

[57] ABSTRACT

A settable warhead burst range selector permits the user of a weapon to rapidly change a chambered flechette ejecting projectile from a muzzle-burst mode to an extended-range mode. A slide containing a pyrotechnic delay is held in a neutral, muzzle burst mode, by a slide positioning locking plate. The pyrotechnic slide has flash ports along its length which are designed to cause flechette expulsion in either the muzzle-burst or the extended-range mode. The range mode is selected by twisting a knurled sleeve into a specific camming position. The sleeve is connected to a striker pin which projects into the weapon chamber area. The striker pin is capable of striking and dimpling the round in the chamber. A dimpled round will cause the slide positioning locking plate to detent the pyrotechnic slide so that the round will be in its extended range mode. An undimpled round will permit the pyrotechnic slide to move so that the round is in its muzzle-burst mode.

4 Claims, 6 Drawing Figures

SETTABLE WARHEAD BURST RANGE SELECTOR

GOVERNMENTAL INTEREST

The invention described herein may be manufactured, used and licensed by or for the Government for governmental purposes without the payment to me of any royalty thereon.

BACKGROUND OF THE INVENTION

Weapons utilizing flechettes as a kill mechanism often have considerable advantages over weapons using fragmenting warheads. The more streamlined flechettes are less susceptible to slowdown than the rather chunky fragments and thus sweep over a much larger lethal area. Furthermore, all flechettes can be directed toward a target whereas with a fragmenting warhead, a high percentage of the fragments are projected harmlessly into the air. It can be shown that for values of range to target of several hundred meters, flechette-type weapons are considerably more effective than fragment-type weapons. For extended target ranges, however, flechette effectiveness deteriorates primarily resulting from too sparse of a flechette pattern. FIG. 1 shows a plot of kill probability ($P_K$) as a function of range to target in meters. The deterioration in $P_K$ beyond 200 meters is analogous to a shotgun shell which is quite effective close in, but becomes ineffective at higher ranges due to sparsity of the expanding buckshot pattern and slowdown. Fragment round effectiveness is relatively insensitive to increases in range to target since the warhead is first projected into a target area and then chemical energy from the explosive propels the fragments the remaining short distance to the target. Flechettes, on the other hand, have all of their energy imparted to them at the gun and depend on their low drag profile to retain the maximum kinetic energy until target intercept. Although flechette slowdown enroute to the target is tolerable, the expansion of the flechette cloud becomes excessive at the extended ranges resulting in reduced effectiveness.

SUMMARY OF THE INVENTION

The present invention relates to a settable warhead burst range selector which solves the problem of reduced effectiveness at extended ranges.

The present device delays the expulsion of the flechettes from the carrier vehicle until it is in closer proximity to the target. Thus, the flechettes travel enroute to the target in a relatively aerodynamically clean projectile and at a propitious moment are expelled to continue to the target. In the present invention the range between flechette expulsion and target intercept is considerably reduced, thus the flechette cloud diameter is reduced and the flechette density is increased.

The net effect of the delayed flechette ejection is to shift the optimum ejection point $R_1$ in FIG. 1 downrange, as shown in FIG. 2. For the downrange conditions, optimum performance of the weapon at points $R_2$ or $R_3$ is degraded only by the additional slowdown of the flechette carrier enroute to the ejection point.

As an additional consideration, the burst range selector mechanism of the present invention permits the defeat of the close-in surprise target (few meters or less from muzzle). A round not having range selection and fuzed to function several hundred meters downrange would be almost totally ineffective against such a target. Similarly, fragmentation rounds are ineffective against close-in targets in that they must be fuzed to detonate at distances sufficiently far removed from the gunner so that he will be safe from the fragments of his own weapon.

The prime advantage of the range selector concept of the present invention is that it permits selection of round functioning distance for rounds already chambered. Thus, for example, if a soldier is surprised by an enemy coming from behind a bush only a few yards away, he can instantly select the muzzle-burst mode even if he was previously firing in the extended range mode. Prior art warheads using time fuzing generally require unchambering of rounds fuzed for extended range use and reloading with muzzle burst fuzed rounds.

An object of the present invention is to provide a settable warhead burst range selector for a chambered round.

Another object of the present invention is to provide a settable warhead burst range selector for a flechette carrying round which is effective against a target at an extended range.

A further object of the present invention is to provide a settable warhead burst range selector for a flechette carrying chambered round which can be rapidly changed from an extended-range mode to a muzzle-burst mode without removal of the round from the weapon chamber.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 5:
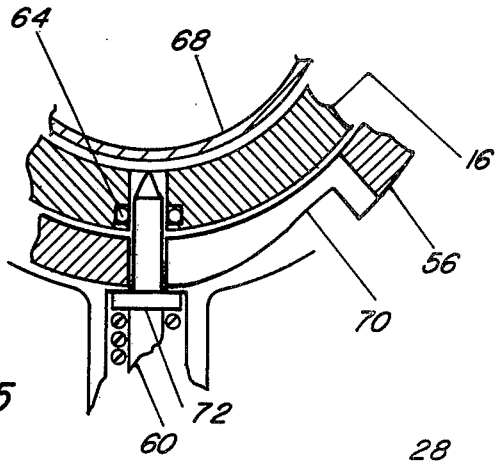
FIG. 5 is a partial cross-sectional view taken along line 5-5 of FIG. 3.
Figure 4:
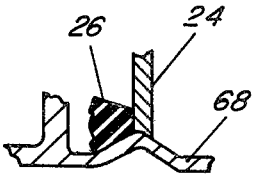
FIG. 4 is a partial, cutaway, cross-sectional view of the chambered round after it has been dimpled.
Figure 3:
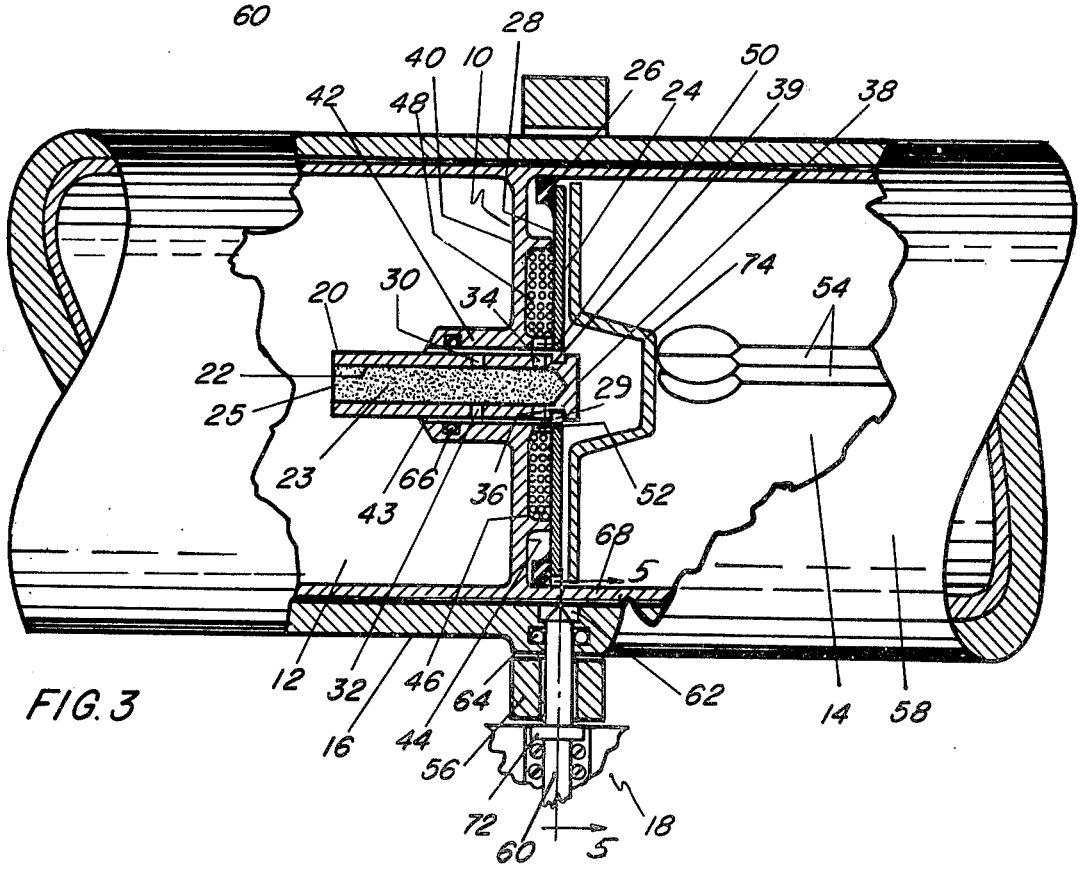
FIG. 3 is a partial cutaway diametral longitudinal cross-sectional view of the bulkhead section of a chambered rocket boost type round, in a weapon gun barrel in the area of the dimpling striker mechanism.

Referring now to FIGS. 3–5 the bulkhead section 10 of a rocket boosted type round is located intermediate and separates the rocket motor chamber or propellant chamber 12 from the payload area 14. The bulkhead section 10 is positioned in the weapon chamber wall 16 so that the bulkhead section 10 is slightly to the left of and above the dimpling assembly 18. The range selector mechanism has two main components, a tubularly shaped slide 20 having a central bore 22 which contains a pyrotechnic delay mixture 23 therein and a slide positioning locking plate 24. The slide open end 25 faces the rocket motor chamber 12. Locking plate 24 keeps the slide 20 in either a quick fire, close in, muzzle-burst mode or locks the slide 20 in an extended-range mode. Locking plate 24 is maintained in a "neutral" position, as shown in FIG. 3, by an annularly shaped compliant member 26, which may be made of soft rubber, which is attached peripherally to a first side 28 of locking plate 24. Locking plate 24 has an axial bore 29 therein which allows slide 20 to pass therethrough when slide 20 is in its neutral position and when it is desired to place the round in a muzzle-burst mode. The pyrotechnic slide 20 has a pair of rear flash ports 30 and 32 and a pair of forward flash ports 34 and 36. The closed front end 38 of slide 20 has an annularly shaped locking groove 39 adjacent thereto. When the slide 20 is in its "neutral" position, locking plate 24 is aligned with groove 29. The rear side 40 of bulkhead section 10 has an axially positioned tubularly shaped slide boss 42 integral therewith and an axial bore 43 for holding slide 20 therein. The front side 44 of bulkhead section 10 has an axial annularly shaped expulsion charge cavity 46 therein which contains a flechette expulsion charge 48. A pair of bores 50 and 52 communicate with axial bore 43 and expulsion charge cavity 46. Bores 50 and 52 permit the hot ignition gases of the pyrotechnic delay mixture 22 to ignite the expulsion charge 48 through either the rear flash ports 3, 32 or the forward flash ports 34, 36 depending upon whether the dimpling assembly 18 has been set for a muzzleburst or extended-range mode.

The aforedescribed device is equally applicable to rounds that are rocket motor boosted projectiles as well as projectiles that depend entirely on the propellant gases of a gun chamber for their launch velocity. The rocket boosted configuration is shown as an illustrative example of the preferred embodiment. In the case of a non-rocket boosted projectile, the pyrotechnic slide 20 is mounted in the base of the projectile, instead of in the bulkhead 10. In the non-rocket boosted projectile, the hot gases from the cartridge propellant ignite the delay mixture 23 in the slide 20.

In operation, a plurality of flechettes 54 have their expulsion range selected by twisting of a knurled camming sleeve 56 surrounding the gun barrel 58. Sleeve 56 is in sliding contact with special biased striker pin 60, the latter passes through the chamber wall 16 through striker pin bore 62. A first gas seal 64 surrounding the pin 60 prevents the escape of round launching gases. A second gas seal 66 located in slide boss 42 prevents the escape of the rocket boost gases from the propellant chamber 12 into the expulsion charge 48 and thus the possible premature ignition of the expulsion charge 48. Linkage mechanism between the gun's firing pin, not shown, and the striker pin 60 assures that the round will be dimpled, if the extended-range mode is desired, prior to round firing. As can be seen from FIG. 5, maximum counter clockwise rotation of the knurled sleeve 56 prevents dimpling of the round wall 68, whereas maximum clockwise rotation of sleeve 56 permits full dimpling of round wall 68 as illustrated in FIG. 4. The dimpling action is accomplished by the striker pin 60. The tapered cam section 70 of the knurled sleeve 56 acts as a variable control shim between the chamber wall 16 and the striking pin shoulder 72. Dimpling of the side of the round wall 68 is easily accomplished since it occurs in the rear portion of the relatively soft casing surrounding the flechette payload 54. Because setback forces are low, this wall 68 can be quite thin.

The extended-range mode is selected by twisting the knurled sleeve 56 on the gun barrel 58 clockwise. In the clockwise position, the striker pin 60 is permitted to strike and dimple the side of the round wall while the round is in the gun chamber. The deformation or dimpling of the side of the round wall 68, in the area of the locking plate 24, forces the latter to move toward and into slide locking groove 39. The aforementioned movement of locking plate 24 locks pyrotechnic slide 20 so that it cannot move axially within the slide boss 42 when, an instant later, the propellant chamber 12 is ignited. The gas pressure generated within propellant chamber 12 will not dislodge slide 20. Thus the slide 20 remains in its maximum effective delay length position and the rocket motor burn can proceed to completion prior to flechette 54 ejection by pusher plate 74. In the case of unboosted rounds the projectile can coast to the desired range prior to flechette ejection.

Figure 1:
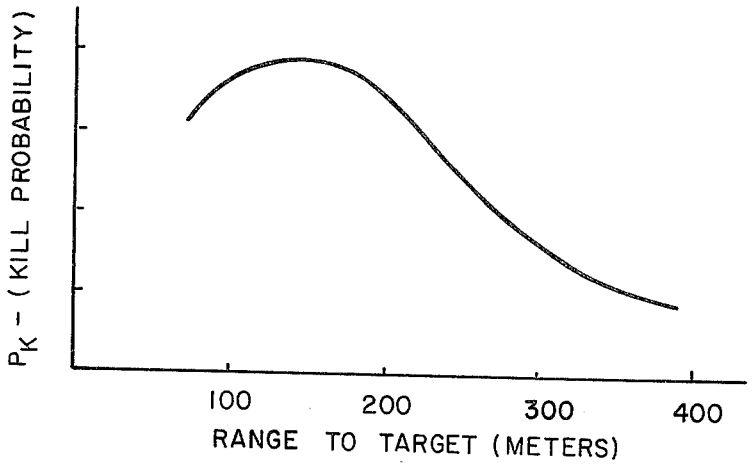
FIG. 1 is a plot of kill probability ($P_K$) as a function of range to target in meters for a flechette carrying round which is not range settable.
Figure 2:
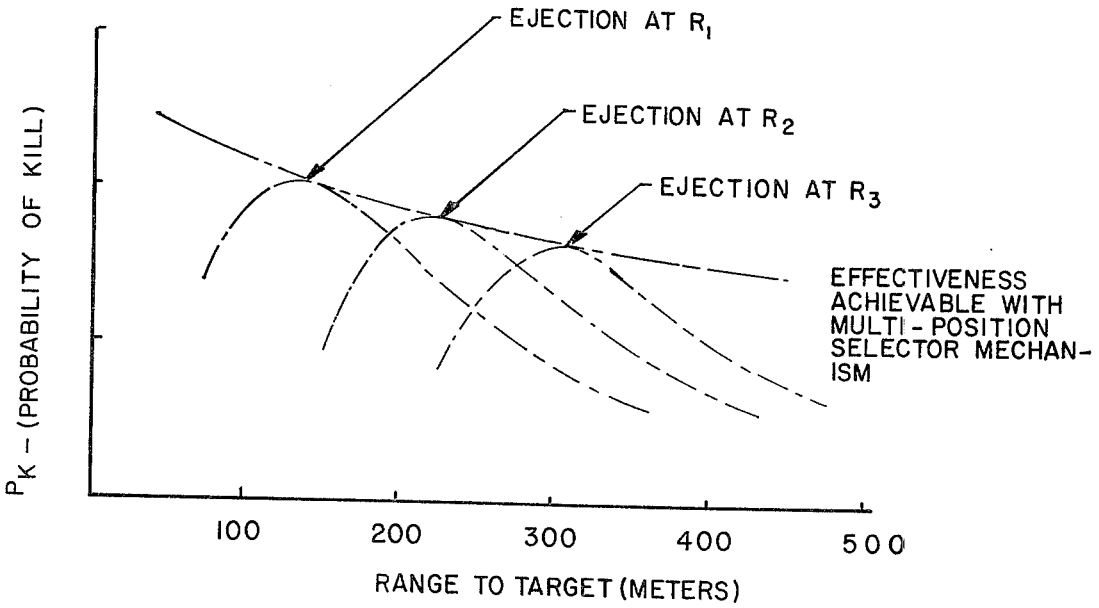
FIG. 2 is a plot of kill probability ($P_K$) as a function of range to target showing how the effectiveness can be extended with a multi-position range selector device.

To select the muzzle-burst mode or close-in range, the knurled sleeve 56 is twisted counter-clockwise. In this positon, the striker pin 60 is locked and cannot dimple the round as shown in FIG. 4, and the pyrotechnic slide 20 remains unlocked. Upon motor ignition and gas pressure build up, the pyrotechnic delay column 22, located in the pyrotechnic slide 20, is ignited by the hot gases and forced forward by the motor chamber pressure. This pressure easily overcomes the setback force acting on the slide during round acceleration. The slide 20 moves forward until stopped by pusher plate 74, whereby the rear flash ports 30 and 32 line up with the bulkhead bores 50 and 52 and flechette expulsion charge 48. In the forward position, the effective length of the delay column 22 is shortened, thus the expulsion charge 48 is ignited prior to completion of motor burnout. The actual expulsion point can be controlled during round fabrication by proper selection of the length of the pyrotechnic delay column 22, burn rate, and the positioning of the rear flash ports 30, 32. FIG. 3 illustrates the $R_1$, $R_2$ expulsion configuration shown in FIG. 2. In order to achieve the muzzle-burst mode, the delay column length is shortened so that there is no delay mixture 23 aft of the rear flash ports 30, 32.

Figure 6:
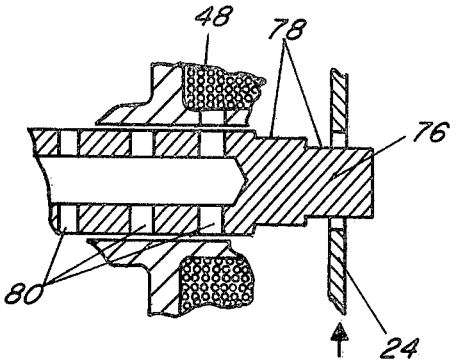
FIG. 6 is a partial cross-sectional view of an alternate embodiment of the pyrotechnic slide shown in FIG. 3.

An alternate design, which would permit selection of several different flechette ejection ranges, is shown in FIG. 6. This concept would have the capability of ejecting the payload close in (at or shortly after the muzzle), at motor burnout or after motor burnout and coast of an additional 100 or more meters. In this embodiment, the knurled sleeve 56 shown in FIGS. 3 and 5 has several defined positions corresponding to the aforementioned ejection ranges. The position of the knurled sleeve 56 would dictate the depth to which the striker pin 60 is permitted to penetrate (dimple) the side of the round wall 68.

In this embodiment the degree of dimpling determines the amount of lateral displacement of a stepped delay slide 76. The pyrotechnic stepped slide 76 has various steps 78 machined into its diameter. These steps correspond to different positions that the slide may assume, based on the degree of lateral displacement of the locking plate 24. These positions align different flash ports 80 with the flechette expulsion charge 48 and thus achieve ejection of the flechettes at ranges commensurate with those yielding optimum weapon effectiveness.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. A settable warhead burst range selector for a flechette dispersing round which comprises:

a gun barrel having a chamber wall with a transversely positioned pin bore therein, said pin bore having a first gas seal therein;

a bulkhead section transversely positioned in the wall of said round intermediate a propellant chamber and a payload chamber, an axially positioned slide boss which protrudes from the rear side of said bulkhead into said propellant chamber, said boss having an axial bore and a second gas seal therein, an annularly shaped charge cavity positioned in the front side of said bulkhead, and at least one bore intermediate said charge cavity and said axial bore and communicating therewith;

an expulsion charge positioned in said charge cavity;

delay means for igniting said expulsion charge; and detent means for setting said delay so that said round is set in an extended-range mode or in a muzzle-burst mode.

2. A settable warhead burst range selector as recited in claim 1 wherein the delay means comprises:

a tubularly shaped slide having closed and open ends, a central bore, and at least one rear flash port and at least one forward flash port, each of said rear and front ports communicating with said central bore, and an annular locking groove peripherally positioned adjacent the closed end of said slide; and a pyrotechnic delay mixture contained within said central bore.

3. A settable warhead burst range selector as recited in claim 2 wherein the detent means comprises:

a knurled cam sleeve positioned around said gun barrel adjacent said pin bore, said cam sleeve having a tapered section thereon;

a striker pin having a shoulder thereon positioned in said pin bore, said tapered section rotatably positioned intermediate said chamber wall and said shoulder so that said striker pin may be actuated to dimple the wall of said round when it is desired to place said round in said extended-range mode; and a locking plate having an axial bore therein transversely positioned over said slide in-line with said annular locking groove and adjacent said expulsion charge, an annular compliant member peripherally attached thereto and in contact with the inside wall surface of said round, said plate being laterally displaced so that the inside surface of said axial bore of said plate engages said annular locking groove thereby preventing the lateral movement of said slide when said round is placed in said extended-range mode.

4. A settable warhead burst range selector as recited in claim 1 wherein the delay means comprises:

a tubularly shaped slide having a closed end which has a plurality of locking steps peripherally positioned thereon and an open end, a central bore, a plurality of flash ports which communicate with said central bore positioned along said slide relative to the length of said steps; and a pyrotechnic delay mixture contained within said central bore.

* * * * *